United States Patent [19]

Larizza

[11] Patent Number: 4,518,273

[45] Date of Patent: May 21, 1985

[54] INSTRUMENT FOR WRITING AND DRAWING WITH PIVOTABLE COVER

[75] Inventor: Pietro Larizza, Limbiate, Italy

[73] Assignee: Larizza & Scuratti s.d.f., Limbiate, Italy

[21] Appl. No.: 491,824

[22] Filed: May 5, 1983

[30] Foreign Application Priority Data

Sep. 30, 1982 [IT] Italy ..... 23063/82[U]

[51] Int. Cl.[3] ..... B43K 9/00

[52] U.S. Cl. ..... 401/98; 401/202; 401/213; 401/243; 401/247

[58] Field of Search ..... 401/98, 202, 213, 243, 401/191, 247

[56] References Cited

U.S. PATENT DOCUMENTS

| | | | |
|---|---|---|---|
| 1,615,506 | 1/1927 | Felt | 401/247 |
| 1,859,775 | 5/1932 | Hyams | 401/98 |
| 2,370,414 | 2/1945 | Ostrander | 401/191 X |
| 2,675,005 | 4/1954 | Smith et al. | 401/191 X |

FOREIGN PATENT DOCUMENTS

| | | | |
|---|---|---|---|
| WO82/00614 | 3/1982 | PCT Int'l Appl. | 401/213 |

*Primary Examiner*—Steven A. Bratlie

*Attorney, Agent, or Firm*—Seidel, Gonda & Goldhammer

[57] ABSTRACT

An instrument for writing or drawing comprises a main body containing a writing element and a closing member pivotally connected to the former by resilient means allowing for a reciprocal rotation of the parts.

11 Claims, 7 Drawing Figures

INSTRUMENT FOR WRITING AND DRAWING WITH PIVOTABLE COVER

This invention relates to an instrument for writing or drawing such as a ball-point pen, a brush-like pen, a pencil or similar devices for tracing, marking, etc. comprising a marking point that is to be protected when the instrument is not used.

The aim of the invention is to realize a one-piece device having a new swingable connection that allows for an increased length when the device is to be used.

The invention will now be disclosed with reference to the attached drawings in which:

FIGS. 1 and 2 are a top view and a side view of a pen according to the invention respectively;

FIGS. 3 and 4 illustrated the opening of the device;

Figure 1:
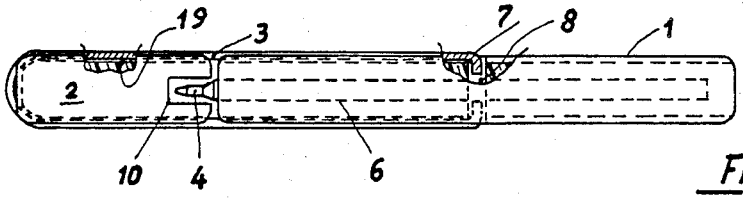
Figure 2:
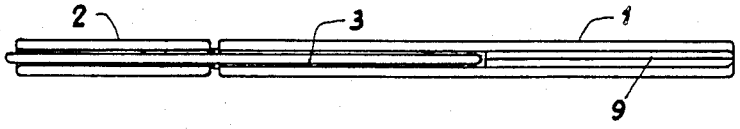

With reference to FIGS. 1 and 2, a ball-point pen built according to the invention is formed by a main body 1 encasing a replaceable magazine of ink 6, usually named refill, having a writing tip 4 (or in case the nib of the tapered synthetic fibers in a brush-like pen, a graphite core, etc.) and by a closing member 2 substantially acting as a holder or cap. the body 1 and closing member 2 are pivotally connected together by a resilient member 3. Preferably the main body 1 is moulded from plastics material with a flattened shape and two longitudinal grooves 9 extending along the thinner sides.

The closing member 2 has a cross-section substantially equal to that of the main body 1 and preferably a shorter length. Furthermore there are provided longitudinal grooves 19 on portion 2, preferably aligned with groove 9 on closing member 2. At one end of member 2 there is provided a cut or slot 10 adapted to house the tip 4 when the pen is closed. The body 1 and member 2 are connected together by a slender elastic tread-like member 3 shaped as an elongated U and having the ends 7 folded at right angles. Resilient member 3 is preferably an elastic steel wire having a thickness of 1–2 mm engaging into the grooves 9 of the main body and 19 of the closing member 2 after a temporary elastic deformation for fitting the ends 7 into a transverse hole 8 on body 1. After being assembled the pen assumes a configuration such as the one shown in FIGS. 1 and 2 wherein it is clear that the main body 1 can be rotated about the pins formed by the ends 7. The closing member 2 can be either further restrained to the guide member 3 or left free of moving along such a guide without prejudice of the working.

Figure 3:
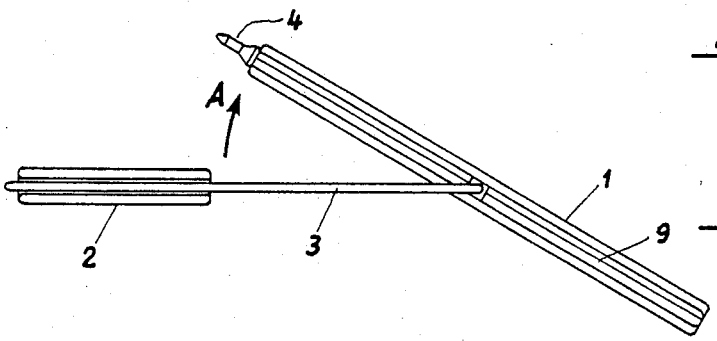
Figure 4:
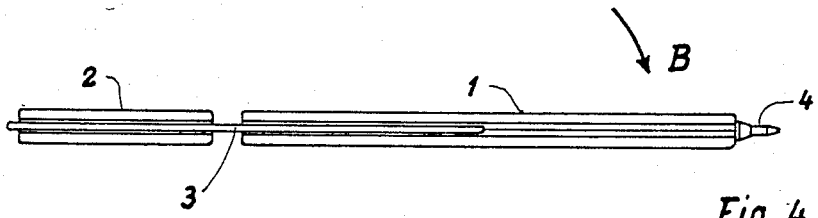
Figure 6:
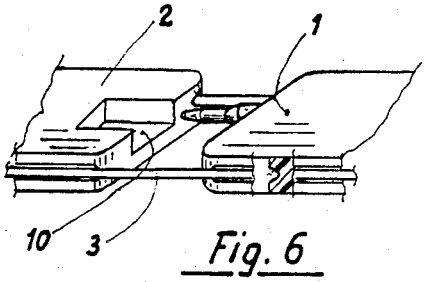
FIG. 6 shows a detail of the closed pen.

With reference to FIGS. 3 and 4 there is illustrated the manner in which the pen is used. By applying a moderate pressure to the main body 1 near to the tip (arrow A), the main body is partially disengaged from the member 3 so that it can be swung about the axis of hole 8. After an almost complete rotation of 180° of the main body 1 with respect to the structure, it is only necessary to press the member 3 into grooves 9 to obtain the pen ready for use (arrow B).

Figure 5:
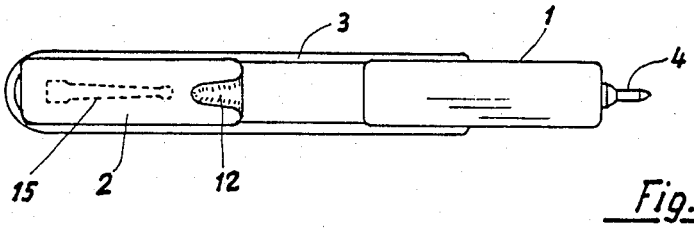
FIG. 5 shows the pen extended ready for use.

The writing tip 4 on the main body 1 can be tapered, as shown by FIG. 5. In this case the end portion of the closing member 2 has a similarly tapered recess 12 into which the tip 4 extends. The rotation of main body 1 can take place in two opposed directions if the member 2 is formed with a recess 12 as shown in FIG. 5. FIG. 5 also shows another feature of the invention according to which the hole 8 is not drilled in the middle of the main body 1. This allows for a greater length of the open pen or, otherwise stated, a shorter length of the closed pen with the same usable length when writing. Another feature, shown in FIG. 5, is the presence of the clip 15 fastened by a joint or a similar means to the closing member.

Figure 7:
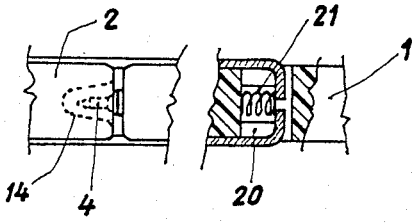
FIG. 7 illustrates another feature of a pen according to the invention.

Finally, according to another feature shown in FIG. 7, the housing for the tip can be an axial blind hole 14 for a better protection against the dust. In this case the other end of the main body is provided with a hole 20 housing a spring 21 pressing the ends 7 of member 3. For the opening, a force is longitudinally applied in order to compress the spring 21 and disengage the writing tip from the blind hole 14. Upon relieving the force the spring 21 stretches again improving the engagement of the parts. When providing this feature the cross-sections of the main body and closing member can be cylindrical or elliptical and the ends 7 can move within two grooves or slots for allowing the disengagement of tip 4 from the housing.

Whereas the invention has been disclosed with reference to a ball-point pen, it extends to the obvious modifications of design achieving the same object to realize a writing or drawing implement wherein the protection for the writing tip is substantially similar whereby the main body is restrained by a resilient member allowing for a reciprocal rotation of 180°. Minor features and characteristics of the invention, such as the particular embodiment of the restraining means, the cross-section of the parts, the presence of fastening clips, or different shapes of the housing for the writing tip come therefore within the scope of the invention.

What I claim is:

1. An instrument for writing or drawing comprising an elongated main body provided with a writing tip at one end thereof, longitudinal grooves extending for the entire length of the main body, a cover member carrying a pair of resilient members, said resilient members being pivotably connected at their ends to a fixed location on the main body, said resilient members being spaced apart so as to resiliently engage the grooves on the main body when the main body and the cover member are aligned.

2. An instrument in accordance with claim 1 wherein the cover member is provided with a notch on one surface thereof for receiving the writing tip when the main body and cover member are aligned.

3. An instrument in accordance with claim 1 wherin the cover member is provided with a recess on one end thereof for receiving the tip when the main body and the cover member are aligned.

4. An instrument in accordance with claims 2 or 3 wherein the main body and the closing member have similar cross sections, the cover member being provided with a pair of parallel grooves, said resilient member being an elongated U-shaped metallic member firmly engaging the grooves of the cover member.

5. An instrument in accordance with claim 4 wherein the main body and the cover member are pivotably connected together by the free ends of said metallic member which are bent at right angles and extend into an opening formed at the bottom of said longitudinal grooves on the main body at said fixed location.

6. An instrument for writing or drawing comprising an elongated body having a writing tip at one end, a cover member having an opening at one end for receiving said tip in a closed position of the instrument, said body having longitudinal grooves on opposite sides thereof and extending for the entire length of said body, means for facilitating pivotable movement of the body about a fixed axis thereon relative to the cover member, said means including a pair of resilient members each partially disposed in one of said grooves in each of the open and closed positions of the body relative to the cover member, said cover member having a pair of grooves on opposite faces thereof, each groove on the cover member receiving one of said resilient members.

7. An instrument in accordance with claim 6 wherein said resilient members are the legs of a U-shaped member having its bight at the other end of the cover member.

8. An instrument for writing, marking, drawing or the like comprising a body portion having forward and rearward ends, a tip projecting from said forward end, a cover member provided with a recess sized to receive said tip, said body portion and cover member being coupled together by a coupling member having a pair of laterally resilient legs journaled on opposite sides of said body portion for rotative movement about a fixed axis extending transversely of said body portion intermediate its ends, said resilient legs and said cover member being rotatable together relative to said body portion about said axis between a first position and a second position, in said first position said legs extend forwardly from said axis longitudinally along opposite sides of said body portion to a location beyond said forward end with said cover member being disposed forwardly of said forward end and with said tip being within said recess, in said second position said legs extending rearwardly from said axis longitudinally along opposite sides of said body portion to a location beyond said rearward end with said cover member also being disposed rearwardly of said rearward end, and grooves on opposite sides of said body portion and extending for the entire length of said body portion, said legs being biased into removable engagement with said grooves to releasably latch said cover member relative to said body portion in each of said first and second positions.

9. An instrument in accordance with claim 8 wherein the cross sectional configuration of said cover member is substantially the same as that of said body portion, and said cover member having longitudinally extending grooves on opposite sides thereof in alignment with said grooves on said body portion in each of said positions.

10. An instrument in accordance with claim 9 wherein said resilient legs are coupled together by a bight portion located adjacent an end of the cover member remote from said recess.

11. An instrument in accordance with claim 10 wherein said body portion and cover member are generally rectangular in cross section, said grooves being disposed along the narrower sides of said body portion and cover member, and said legs being a single elongated resilient rod having offset pins at the ends of the legs remote from said bight portion, said pins extending along said axis.

* * * * *